US009981400B2

(12) United States Patent
Dreier et al.

(10) Patent No.: US 9,981,400 B2
(45) Date of Patent: May 29, 2018

(54) APPARATUS FOR SLICING FOOD PRODUCTS AND METHOD OF PROVIDING INTERMEDIATE SHEETS

(71) Applicant: Weber Maschinenbau GmbH Breidenbach, Breidenenbach (DE)

(72) Inventors: Jonas Dreier, Breidenbach (DE); Hans Christian Weiss, Dillenburg (DE)

(73) Assignee: WEBER MASCHINENBAU GMBH BREIDENBACH, Breidenbach (DE)

( * ) Notice: Subject to any disclaimer, the term of this patent is extended or adjusted under 35 U.S.C. 154(b) by 88 days.

(21) Appl. No.: 14/452,854

(22) Filed: Aug. 6, 2014

(65) Prior Publication Data

US 2015/0053057 A1 Feb. 26, 2015

(30) Foreign Application Priority Data

Aug. 22, 2013 (DE) ..... 10 2013 216 717

(51) Int. Cl.
*B26D 3/00* (2006.01)
*B26D 5/20* (2006.01)
(Continued)

(52) U.S. Cl.
CPC ..... *B26D 7/325* (2013.01); *B65B 25/08* (2013.01); *B26D 1/14* (2013.01); *B26D 7/0625* (2013.01);
(Continued)

(58) Field of Classification Search
CPC ..... B26D 7/325; B26D 7/0625; B26D 1/14; B26D 2210/02; B65B 25/08; Y10T 83/0538; Y10T 83/4453; Y10T 83/6657
(Continued)

(56) References Cited

U.S. PATENT DOCUMENTS 2,813,798 A * 11/1957 Toby ..... B65B 25/08 426/420
3,411,388 A * 11/1968 Rappaport ..... B26D 5/26 156/353
(Continued)

FOREIGN PATENT DOCUMENTS

DE 19518597 A1 11/1996
DE 19646619 A1 5/1998
(Continued)

OTHER PUBLICATIONS

German Search Report dated Jul. 2, 2014; Relating to German Patent Application No. 102013216717.2; 4 pages.
(Continued)

*Primary Examiner* — Ghassem Alie
*Assistant Examiner* — Bharat C Patel

(57) ABSTRACT

An apparatus for slicing food products includes a product feed and an interleaver. The product feed is operable to supply products to a cutting plane in a plurality of tracks running in parallel next to one another. At least one cutting blade is moved in the cutting plane. The interleaver has a conveying device for each track that is operable to convey a front end region of an interleaved sheet material web through the cutting plane in each track to provide the front end region in the respective track as an interleaved sheet between cut-off product layers. The interleaver is operable individually per track and each conveying device is configured such that it conveys the respective front end region of the respective interleaved sheet material web through the cutting plane individually per track in dependence on an angular position of the cutting blade.

36 Claims, 4 Drawing Sheets

Figure 1:
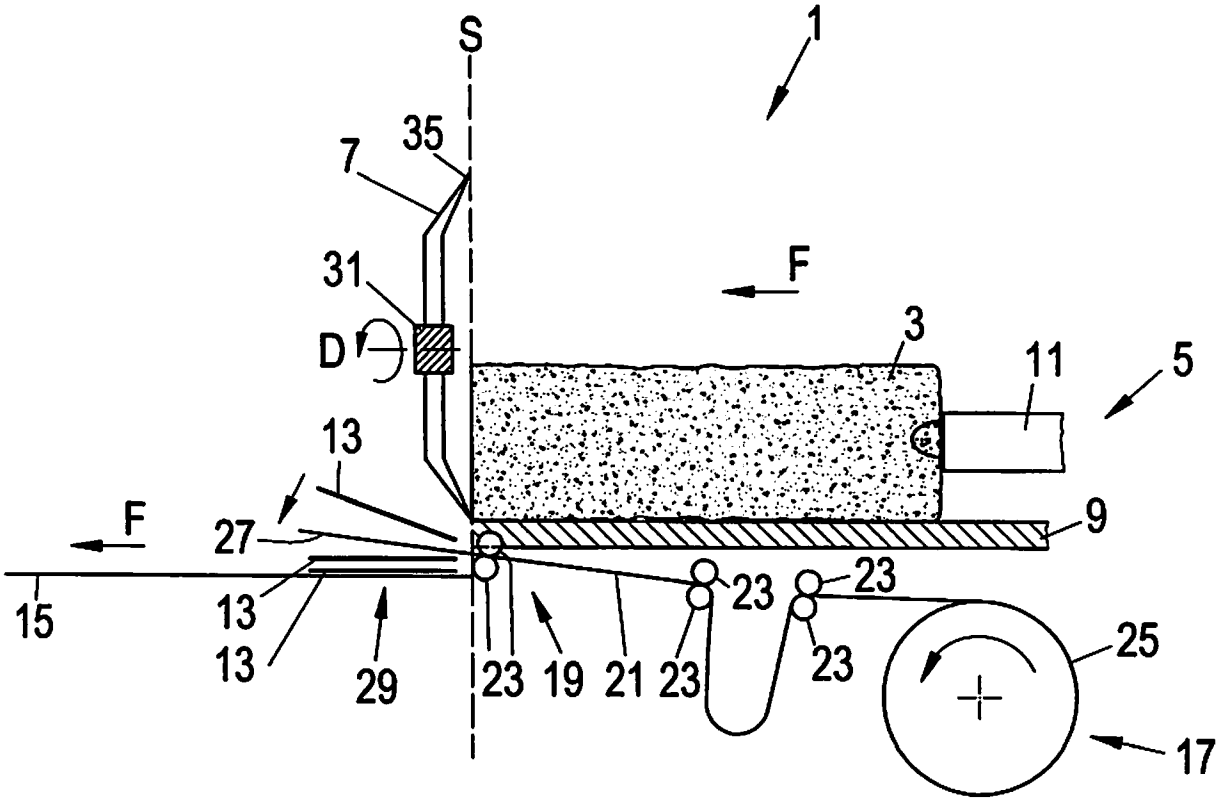

(51) Int. Cl.

| | |
|---|---|
| ***B23D 25/00*** | (2006.01) |
| ***B26D 7/32*** | (2006.01) |
| ***B65B 25/08*** | (2006.01) |
| *B26D 1/14* | (2006.01) |
| *B26D 7/06* | (2006.01) |

(52) U.S. Cl.
CPC ..... *B26D 2210/02* (2013.01); *Y10T 83/0538* (2015.04); *Y10T 83/4453* (2015.04); *Y10T 83/6657* (2015.04)

(58) Field of Classification Search
USPC .... 83/42, 437, 207, 90, 277, 417, 76.7, 395, 83/703, 98, 592, 522.1, 355, 360
See application file for complete search history.

(56) References Cited

U.S. PATENT DOCUMENTS 3,538,674 A * 11/1970 Clemens ..... B26D 7/27 53/157
3,982,454 A * 9/1976 Schneider ..... B23D 36/0041 700/167
4,083,277 A * 4/1978 Lotz ..... B65H 29/58 271/296
4,091,315 A * 5/1978 Hayashi ..... B23D 45/22 318/603
4,226,147 A * 10/1980 Kumzi ..... B26D 7/0683 700/160
4,428,263 A * 1/1984 Lindee ..... B26D 7/018 83/354
4,532,840 A * 8/1985 Antonissen ..... B26D 5/20 83/278
4,572,044 A * 2/1986 Antonissen ..... B26D 5/20 83/364
4,644,729 A * 2/1987 Fessler ..... B26D 7/01 53/157
4,894,976 A * 1/1990 Wallace ..... B26D 7/27 53/157
5,482,166 A * 1/1996 Brown ..... A22C 17/002 209/580
5,613,675 A * 3/1997 Kruger ..... B65H 5/34 271/265.01
5,628,237 A * 5/1997 Lindee ..... B26D 1/0006 83/403.1
5,649,463 A * 7/1997 Lindee ..... B26D 1/0006 83/174
5,659,538 A * 8/1997 Stuebe ..... A61F 13/15723 700/124
5,704,265 A 1/1998 Johnson et al.
5,724,874 A 3/1998 Lindee et al.
5,979,311 A * 11/1999 Kakurai ..... B41L 13/16 101/118
6,484,615 B2 * 11/2002 Lindee ..... B26D 3/161 30/309
6,591,514 B2 * 7/2003 Kristensen ..... F26B 5/08 34/105
6,776,277 B2 * 8/2004 Wiehler ..... B65H 29/16 198/369.2
7,159,372 B2 * 1/2007 Lindee ..... A22C 7/0084 53/122
7,601,375 B2 * 10/2009 Langton ..... B65D 57/00 426/106
7,603,936 B2 * 10/2009 Pryor ..... B26D 7/01 83/277
7,946,571 B2 * 5/2011 Weiss ..... B65H 7/20 271/10.01
8,262,088 B2 * 9/2012 Uji ..... G03G 15/6564 271/265.01
8,408,109 B2 * 4/2013 Lindee ..... B26D 5/32 83/422
8,424,436 B2 * 4/2013 Weber ..... B26D 1/0006 83/676
2005/0067750 A1 * 3/2005 Ely ..... B65B 57/04 271/9.01
2006/0037284 A1 * 2/2006 Sandberg ..... B65B 25/065 53/122
2008/0250944 A1 * 10/2008 Pryor ..... B26D 7/27 99/537
2009/0241472 A1 * 10/2009 Lindee ..... A22C 7/0084 53/443
2010/0101191 A1 * 4/2010 Lindee ..... B25J 9/0093 53/471
2010/0107836 A1 * 5/2010 Lindee ..... B25J 9/0093 83/23
2012/0055306 A1 * 3/2012 Weber ..... B26D 1/16 83/438
2012/0060658 A1 * 3/2012 Weber ..... B26D 1/143 83/13
2012/0312660 A1 * 12/2012 Harder ..... B26D 7/32 198/604

FOREIGN PATENT DOCUMENTS

DE 19926461 A1 * 12/2000 ..... B26D 7/27
DE 102008038064 2/2010
DE 102011106459 1/2013
DE 102012009648 11/2013
EP 0736361 A2 * 10/1996 ..... B26D 1/16
EP 1940685 B1 12/2011
EP 2543486 A2 1/2013
WO WO 9722447 A1 * 6/1997 ..... B23D 36/005
WO WO2009/027080 3/2009

OTHER PUBLICATIONS

Translation of German Search Report dated Jul. 2, 2014; Relating to German Patent Application No. 102013216717.2; 5 pages.

* cited by examiner

APPARATUS FOR SLICING FOOD PRODUCTS AND METHOD OF PROVIDING INTERMEDIATE SHEETS

The present invention relates to an apparatus for a multitrack slicing of food products, in particular to high-performance slicers, and to a method of providing intermediate sheets on multiple tracks, in particular at such a slicing apparatus.

Apparatus for slicing food products, which are also called slicers or high-performance slicers, are known. Together with packaging machines, such slicers can form efficient production lines with which packages of portions of food slices can be produced fully automatically. The apportioned slicing of food products in multitrack operation is also generally known. In this respect, products are supplied to a cutting plane in a plurality of tracks disposed next to one another and are sliced at high speed by a cutting blade moving in the cutting plane.

It is also known to provide an intermediate sheet feed, which is also called an interleaver, in a slicing apparatus. The provision of an intermediate or interleaved sheet between cut-off product slices takes place by the interleaver.

A slicing apparatus having an interleaver is known from EP 1 940 685 B1 and also from DE 10 2011 106 459 A1.

It is the underlying object of the present invention to provide an improved apparatus for slicing food products as well as an efficient method of providing interleaved sheets.

The object is respectively satisfied by a slicing apparatus having the features of claim 1 and by a method of providing interleaved sheets on multiple tracks having the features of claim 11.

The apparatus in accordance with the invention for slicing food products, in particular a high-performance slicer, comprises

- a product feed by means of which products can be supplied in a plurality of tracks running next to one another to a cutting plane in which at least one cutting blade moves, in particular in a rotating and/or circulating manner; and
- an interleaver which has a conveying device for each track by means of which a front end region of an interleaved sheet material web can be conveyed in the respective track through the cutting plane to provide the front end region in the respective track as an interleaved sheet between cut-off product layers, in particular between individual slices and/or between portions formed by a plurality of slices,
- wherein the interleaver can be operated individually per track and each conveying device is configured such that it carries out the conveying process of the respective front end region of the respective interleaved sheet material web through the cutting plane individually per track in dependence on an angular position of the cutting blade on its orbit.

The rotation in particular takes place about a drive axis with a scythe-like blade. In contrast, a driven circular blade, together with its blade head, runs in a planetary motion on a circular path about a central axis.

With a high-performance slicer, cutting speeds of between 600 and some thousand cuts per minute are possible. Consecutive slices are thus cut off from the product at a very short time interval in each track. In the small length of time which is available between two consecutive cuts, not only the respective product has to be guided by means of the corresponding product feed device, but an interleaved sheet also optionally has to be provided. The interleaved sheet should therefore be able to be conveyed in a relatively short length of time.

With the slicing apparatus in accordance with the invention, each conveying device can provide an interleaved sheet between cut-off product layers as required in the respective track and independently of the other tracks in dependence on the angular position of the cutting blade. Due to the dependence of the conveying process for the front end section individually per track on the angular position of the cutting blade, a track-specific time window available for the respective conveying process during a revolution of the cutting blade can additionally be utilized in a better manner. The starting point in time for the respective conveying process can in particular be matched to the respective track-specifically available time window. The interleaved sheets can therefore also be reliably provided for the conveying process of the interleaved sheets at high cutting speed with correspondingly short time windows.

The term "product layer" generally covers one or more cut-off product slices, i.e. an interleaved sheet can be provided between two mutually following product slices or between mutually following portions of a respective plurality of product slices. In this respect, different product layers between which interleaved sheets are to be provided can be provided in the tracks, i.e. an interleaved sheet can e.g. be provided in one track in each case between mutually following individual slicers and in another track in each case between slice portions.

The cutting blade can e.g. by a circular knife orbiting in planetary motion or a scythe-like blade only rotating about a blade axis.

Each conveying device is preferably configured to start and/or stop the respective conveying process individually per track in dependence on the angular position of the cutting blade. The time window available for the respective conveying procedure during a revolution of the cutting blade can thereby be utilized in an improved manner or ideally. The starting point in time of the respective conveying process can in particular be brought forward in time and can be correlated with the time of the opening of the time window. In other words, it is possible in principle that the respective conveying process is started as soon as the cutting blade reaches that angular position during its revolution at which the time window available for the provision of the interleaved sheet just opens in the respective track.

In a preferred embodiment of the invention, each conveying device is configured to start the respective conveying process individually per track as soon as the angular position of the cutting blade corresponds to an angular position value which is or can be predefined for the respective conveying device. The angular position value can, for example, be the respective angular position value at which the respective time window opens which is available for the interleaved sheet feed individually per tack.

During its revolution, the cutting blade blocks via a respective track-specific angular position region the conveying path of the respective end section or the corresponding cross-section region which is disposed in the cutting plane and through which the respective front end section is conveyed since the cutting blade passes through the conveying path during its revolution over the respective angular position region and in so doing cuts off a front end section from the material web provided during a preceding conveying process. It can therefore be advantageous if, for at least one conveying device, the angular position value at which the respective conveying process is started at least approximately corresponds to the angular position at which the cutting blade releases the cross-sectional region in the respective track through which the respective front end section is conveyed through the cutting plane. The time window available for the respective conveying process can thus be ideally utilized since the conveying process is started as soon as the conveying path for the end section of the cutting blade is released.

With at least one conveying device, the angular position value can at least approximately correspond to the angular position of the cutting blade at which the cutting blade has completely cut off a slice of the product. The respective conveying process can thus be started as soon as the angular position of the cutting blade reaches the above-defined angular position value.

The angular position value can preferably correspond at least approximately to the angular position at which the blade body of the cutting blade completely exits the respective product. The respective conveying process for the interleaved sheet to be provided can thus be started as soon as the cutting blade has released the conveying path of the respective product. It is thus ensured that the conveying path for the interleaved sheet is released.

In particular a different angular position value is or can be predefined for each conveying device. The conveying process for providing the interleaved sheet is thus started at a different angular position value in each track.

The respective track-specific angular position value can depend on the cutting blade. The respective angular position value can in particular be dependent on the type of the cutting blade, in particular on whether it is a circular blade or a scythe-like blade.

The respective angular position value can also depend on the diameter of the cutting blade since the diameter has an effect on the time window for the conveying process of the interleaved sheet available during the revolution of the cutting blade.

The respective angular position value can depend on a cutting blade head via which the cutting blade is arranged at the slicing apparatus. The respective angular position value can in particular depend on the type of the cutting blade head.

The respective angular position value and/or a correction value for the angular position value can depend on the speed of rotation of the blade and/or on the cutting speed.

The respective angular position value can depend on the respective product, in particular on its shape, height and/or width. This can in particular be the case when the respective conveying process for the provision of the respective interleaved sheet is started individually per track as soon as the angular position of the cutting blade reaches the angular position value at which the cutting blade exits the product provided in the respective track.

The respective angular position value can be dependent on the arrangement of the cutting blade, in particular on the arrangement of an axis of rotation, relative to the tracks and/or to the products, in particular to the geometry of the product cross-section. The respective angular position value can also be dependent on the arrangement of a blade head via which the cutting blade is arranged at the slicing apparatus, relative to the tracks and/or to the products, in particular to the geometry of the product cross-section.

In accordance with a preferred embodiment of the invention, each conveying device is configured to stop the respective conveying process individually per track as soon as the angular position of the cutting blade corresponds to a further angular position value which is or can be predefined for the respective conveying device. With a suitably selected further angular position value, it can thereby be prevented, for example, that the respective conveying process takes longer in time than the respective time window available for the conveying process.

The respective conveying process can also be adapted automatically in dependence on the speed of rotation of the cutting blade, in particular via a correction value. Correction values dependent on the speed of rotation of the cutting blade for the respective angular position values can in particular be predefined in a control for the conveying devices to modify the angular position values in dependence on a current speed of rotation of the cutting blade. Effects on the cut-off slices or on the interleaved sheets dependent on the speed of rotation of the cutting blade, such as effects on the drop path, and influences of gravity in the conveying processes for providing the interleaved sheets can thereby be taken into account individually per track.

Each conveying device is preferably configured to carry out the respective conveying process for a length of time, which is or can be predefined, in particular individually per track. The length of time can, for example, be selected such that the provided front end section has a desired length.

The conveying devices are preferably operable independently of the product feed. A positive coupling of any desired type between the product feed and the interleaved sheet conveyor is thus not compulsory. It is therefore possible to supply and slice a product in one or more tracks without interleaved sheets being provided in the respective track or in the respective tracks.

Each conveying device can be configured such that the interleaved sheet is unwound from its own continuous web of interleaved sheet material, preferably comprising paper or plastic.

The invention also relates to a method of providing interleaved sheets on multiple tracks, in particular at an apparatus in accordance with the invention, wherein food products are sliced by at least one cutting blade moving in a cutting plane in a plurality of tracks running in parallel with one another, and wherein a front end region of an interleaved sheet material web is conveyed through the cutting plane in each track in dependence on the angular position of the cutting blade and independently of the other tracks to provide the front end region of the interleaved sheet material web as an interleaved sheet between cut-off product layers, in particular between individual slices and/or between portions formed by a plurality of slices.

Further possible embodiments of the invention are set forth in the dependent claims, in the description and in the drawing.

The invention will be described in the following by way of example with reference to the enclosed, Figures. There are shown, schematically in each case, FIG. 1 a lateral cross-sectional view of an apparatus in accordance with the invention for the multitrack slicing of food products; and FIGS. 2*a*-2*c* front views of a cutting plane of the apparatus of FIG. 1 in which different angular position locations of a cutting blade revolving in the cutting plane are shown.

Figure 2A:
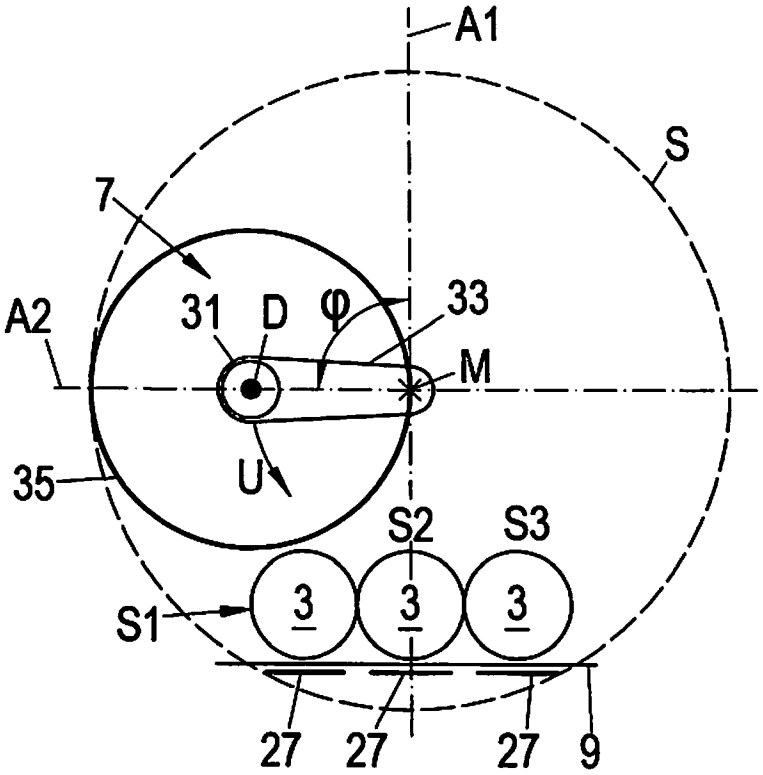
Figure 2B:
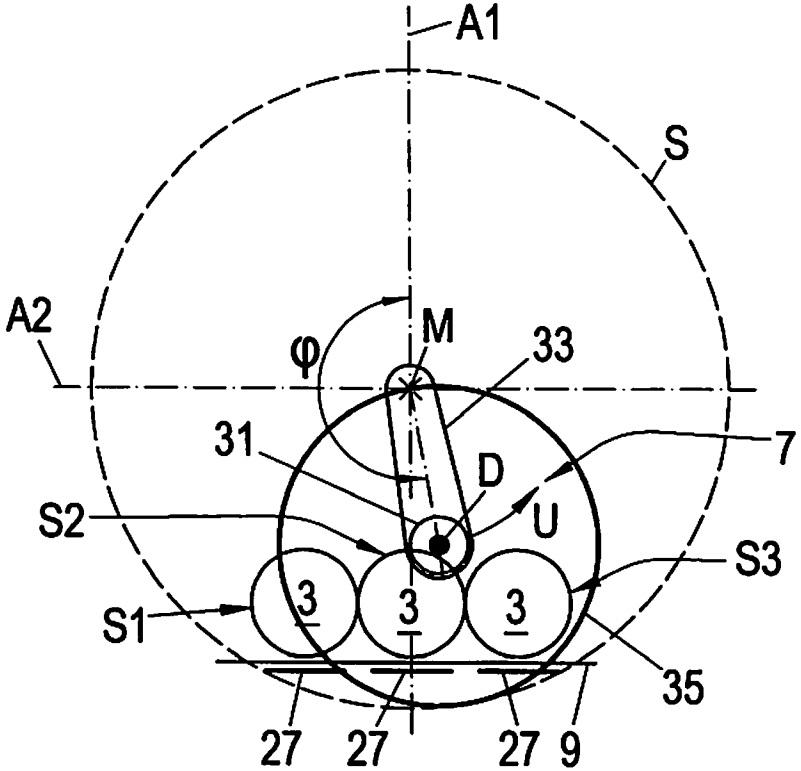
Figure 2C:
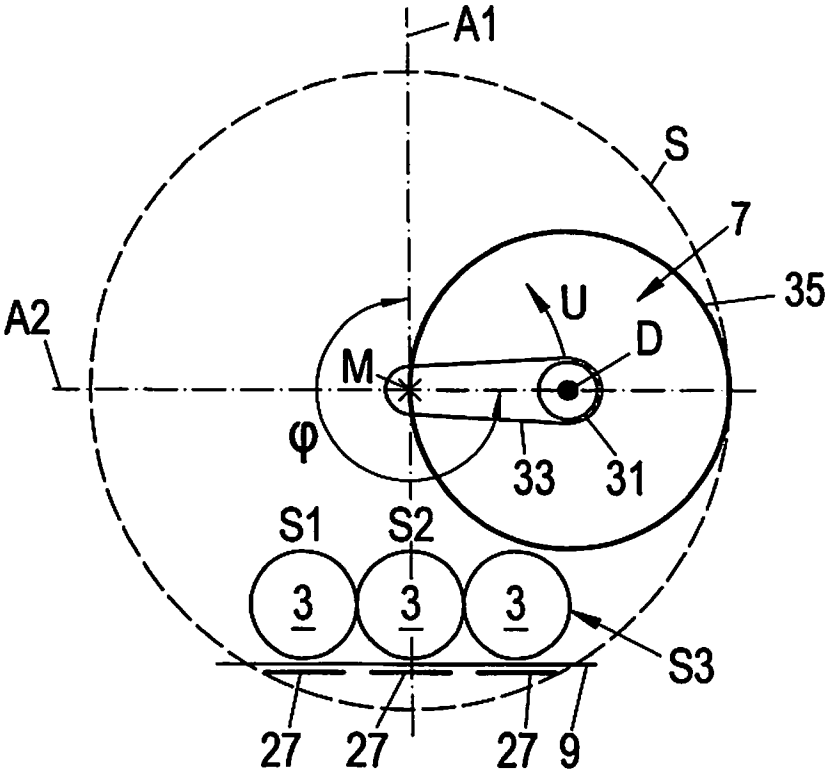

The shown slicing apparatus 1 has a product feed 5 by means of which a product 3 respectively lying on a product support 9 can be conveyed along a conveying direction F and can be supplied to a cutting plane S in a plurality of tracks disposed in parallel next to one another—here three tracks S1, S2, S3 (cf. also FIGS. 2*a*-2*c*). A product gripper 11 of the product feed 5 is associated with each track S1, S2, S3; it engages into the rear end of the respective product 3 and can be traveled along the conveying direction F for conveying the respective product 3.

A cutting blade 7 has a blade edge 35 disposed in the cutting plane S. The revolving cutting blade 7 cuts off slices 13 from the respective front end of the products 3 with its blade edge 35, the slices falling onto a product placement area 15. The cutting blade 7 is a so-called circular blade or orbital blade. The cutting blade 7 has a central opening for a blade mount 31 via which it is fastened to a rocker 33 arranged at a blade head.

In cutting operation, the cutting blade 7 is driven such that it rotates about a blade axis D. Furthermore, the rocker 33 is rotated about a central axis M in cutting operation. The cutting blade 7 thus carries out a revolution U about the central axis M in addition to its own rotation about the blade axis D. A relative movement between the cutting blade 7 and the products 3 is thereby generated which is required for the cutting off of the slices 13.

The revolution can have an angular position Φ associated with it to specify the position of the cutting blade 7 with respect to the revolution U. The angular position Φ can in this respect be given relative to the axis A1 disposed in the cutting plane S and extending perpendicular to the product support 9. The angular position Φ could, however, just as easily be given with respect to any other axis disposed in the cutting plane S, e.g. with respect to the horizontally extending axis A2.

FIGS. 2*a*-2*c* show different angular position locations of the cutting blade 7 relative to the three products 3. In the described example, the cutting process starts in accordance with FIG. 2*a* at an angular position Φ of approximately 90 degrees. The blade edge 35 of the cutting blade 7 in this respect penetrates into the left hand product 3 which lies in the track S1. The respective front ends of the continuously or intermittently supplied products 3 were previously moved beyond the cutting plane 17 and project beyond the cutting plane S by a degree corresponding to the respectively desired slice thickness. In the described example, the cutting process ends after an angular position Φ of somewhat more than 180 degrees since—as FIG. 2*b* shows—the blade edge 35 exits the product 3 disposed in the track S3 at this angular position Φ and a slice was separated from all three products 3 at this time, i.e. at this angular position Φ.

As can furthermore be seen from FIGS. 2*a*-2*c*, the respective track-specific cutting process starts and ends earlier for the product 3 provided in track S1, that is at smaller angular positions Φ, than for the products 3 disposed in the tracks S2 and S3. Correspondingly, the track-specific process for the product 3 provided in track S2 starts and ends earlier than the track-specific cutting process for the product 3 disposed in the track S3.

The slicing apparatus 1 has an interleaver 17 which associates a respective conveying device 19 with each track S1 to S3 to extract a respective interleaved sheet material web 21 from an interleaved sheet material web roll 25 by means of a plurality of rollers 23 and to convey a front end region 27 of the interleaved sheet material web 28 beneath the respective product 3 through the cutting plane S. In this respect, the front end region 27 can be provided in the respective track S1 to S3 as an interleaved sheet likewise cut off by the cutting blade 7 between individual slices 13 and/or between portions formed by a plurality of slices. The total portion 29 thus formed on the product placement area 15 from slices 13 and interleaved sheets 27 can then be conveyed further in the conveying direction F and can, for example, be supplied to a downstream packaging machine (not shown) to package the total portion 29.

The interleaver 17 can be operated individually per track so that each conveying device 19 can convey the respective front end region 27 as required independently of the other conveying devices 19 and can provide it as an interleaved sheet between cut-off slices 13. In this respect, each conveying device 19 is configured such that it carries out the conveying process of the respective front end region 27 through the cutting plane S individually per track in dependence on the angular position Φ of the cutting blade 7. In the slicing apparatus 1, the provision of the interleaved sheets in each track S1 to S3 can thus be matched to the respective track-specific cutting process.

In this respect, in particular the time at which the respective conveying process of a front end section 27 is started can be set or predefined at a control, not shown, for the conveying devices, individually per track in dependence on the angular position Φ of the cutting blade 7. Each conveying device 19 can thus start the respective conveying process individually per track as soon as the angular position Φ of the cutting blade 7 corresponds to an angular position value predefined for the respective conveying device 19.

In accordance with a variant, the angular position value in each track can correspond to that angular position Φ at which the cutting blade 7 just exits the product 3 disposed in the respective track. In FIG. 2*c*, this case is shown for the product 3 in the track S3 since, at the shown angular position Φ of approximately 270 degrees, the blade body of the cutting blade 7 has just completely exited the product 3 in the track S3 again. In accordance with this variant, the conveying device 19 associated with each track S3 thus starts the conveying process of the front end section 27 as soon as the cutting blade 7 has reached the shown angular position location of Φ=270 degrees.

In contrast, the conveying device 19 associated with the tracks S1 and S2 already start the respective conveying process at a respective track-specific smaller angular position since—as FIG. 2*c* shows—the cutting blade 7 has already completely exited the products 3 disposed in these tracks at smaller angular positions.

In accordance with another variant, the angular position value in each track can correspond to that angular position Φ at which the cutting blade 7 releases the cross-sectional region disposed in the cutting plane S through which the respective front end section 27 is conveyed. In other words: The conveying process for the respective front end section 27 is started individually per track at that angular position Φ at which the cutting blade 7 just no longer blocks the respective conveying path of the respective front end section 27 during its revolution U.

For example, the cutting blade 7 just releases the conveying path for the front end section 27 of the track S1 at the angular position of the cutting blade 7 shown in FIG. 2*b*. In the angular position location shown in FIG. 2, the conveying device 19 associated with the track S1 can thus start the conveying process for providing the next interleaved sheet.

In contrast, the cutting blade 7 in accordance with FIG. 2*b* still blocks the conveying path for the front end section 27 of the track S2 so that, in the angular position location shown in FIG. 2*b*, the conveying process for the next interleaved sheet to be provided in the track S2 cannot yet be started.

In addition, in the angular position location in accordance with FIG. 2*b*, a provided front end section 27 is just separated by the cutting blade 7 in the track S3. In this respect, the cutting blade 7 blocks the conveying path for the front end section 27 so that the conveying process for the next interleaved sheet provided in the track S3 can likewise not yet be started.

In accordance with another variant, the angular position value in each track can correspond to that angular position Φ at which the cutting blade 7 has just completely cut off a slice 13 from the product disposed in the respective track. In FIG. 2*b*, this case is shown for the product 3 in the track S3. In accordance with this variant, the conveying device 19 associated with the track S3 thus starts the conveying process of the front end section 27 as soon as the cutting blade 7 has reached the angular position location shown in FIG. 2*b* of somewhat more than Φ=180 degrees.

In contrast, the conveying devices 19 associated with the tracks S1 and S2 already start the conveying process at a respective track-specific smaller angular position since—as FIG. 2*b* shows—a slice 13 is completely cut off from the respective product 3 at smaller angular positions in the tracks S1 and S2.

The respective angular position value individual per track could also be specified differently than in the described variants. In addition, at least two of the described variants could also be used in parallel. For example, the conveying device 19 associated with the track S1 could start the conveying process for the front end section 27 as soon as the cutting blade 7 reaches the angular position Φ, at which it releases the conveying path for the end section 27 for the track S1. The conveying devices 19 associated with the other two tracks could in contrast start the conveying process individually per track as soon as the cutting blade 7 reaches the respective angular position Φ at which the cutting blade 7 has completely cut off a slice.

The respective conveying process can e.g. be carried out individually per track for a predefined length of time. In this respect, the front end section 27 is conveyed at a substantially constant speed by the respective conveying device 19. An interleaved sheet with a desired length can thus be provided by a suitable selection of the length of time for the conveying process.

The respective conveying process can also be carried out individually per track for so long until the cutting blade 7 has reached a respective further angular position value lying behind the angular position value for the start.

As can be seen with regard to FIGS. 2*a*-2*c*, the track-specific respective angular position value of the cutting blade 7, from which onward the conveying process for providing the interleaved sheet is begun in the respective track during the revolution of the cutting blade 7 can depend on the cutting blade 7. The respective angular position value can in particular depend on the diameter of the cutting blade 7.

In addition, the angular position value can depend on the cutting blade type, that is in particular on whether a circular blade or a scythe-like blade is used. A further parameter, on which the respective angular position value can depend, is the speed of rotation of the blade or the cutting speed.

The respective angular position value or a correction value for the angular position value can depend on the respective product 3, in particular on its shape, height and/or width. This is in particular the case in the variant in which the angular position value individual per track for the start of the conveying process corresponds to the angular position Φ, at which the cutting blade 7 completely exits the product 3 disposed in the respective track since in this variant the product dimensions have an effect on the respective angular position value.

The respective angular position value can also be dependent on the arrangement of the cutting blade 7 relative to the tracks S1, S2 and S3. For example, the central axis M could be adjustable along the axes A1 and A2 so that the alignment of the orbit of the cutting blade 7 can be varied relative to the tracks S1 to S3. The orbit of the cutting blade 7 can in particular be aligned with respect to an ideal cutting process. The orbit can in this respect be set such that the front end regions 27 are each cut off by the cutting blade 7 from the side, whereby a clean cut is facilitated. It can be seen in this respect that an adjustment of the central axis M along the axis A1 and/or along the axis A2 also effects a change of the angular position values individual per track which can be used as a criterion for the start or the stop of the respective conveying process for providing the interleaved sheets.

In the embodiment shown, a circular blade is used as the cutting blade 7. A so-called scythe-like blade or spiral blade can, however, also be used which does not revolve in a planetary motion, but only rotates about the blade axis D. An exemplary scythe-like blade is described in WO 2009/027080 A1.

With a scythe-like blade, it is the shape of the blade which generates the relative movement between the blade edge of the blade and the products required for cutting off slices. On a use of a scythe-like blade, the angular position Φ taken into account in accordance with the invention for the respective conveying process of the respective end region 27 is related to the revolution of the scythe-like blade about the blade axis D. Otherwise, the above statements made with respect to the circular blade apply accordingly.

REFERENCE NUMERAL LIST

1 apparatus
3 product
5 product feed
7 cutting blade
9 product support
11 product gripper
13 slice
15 product placement area
17 interleaver
19 conveying device
21 interleaved sheet material web
23 roller
25 interleaved sheet material web roll
27 end region/interleaved sheet
29 total portion
31 blade mount
33 rocker
35 blade edge
S1, S2, S3 track
F conveying direction
S cutting plane
D blade axis
M central axis
U revolution
A1, A2 axis
Φ angular position

The invention claimed is:

1. An apparatus for the slicing of food products, comprising:

a product feed (5) by means of which products (3) can be supplied in a plurality of tracks (S1, S2, S3) running next to one another to a cutting plane (S) in which a cutting blade (7) rotates through a revolution (U) about a central axis (M); and an interleaver (17) which has a conveying device (19) for each track (S1, S2, S3) by means of which a front end region (27) of an interleaved sheet material web (21) can be conveyed in the respective track (S1, S2, S3)

through the cutting plane (S) to provide the front end region (27) as an interleaved sheet between cut-off product layers (13) in the respective tracks (S1, S2, S3), wherein:

the interleaver (17) is operable individually per track and each conveying device (19) is configured to convey the respective front end region (27) of the respective interleaved sheet material web (21) through the cutting plane (S) individually per track based on an angular position (Φ) of the cutting blade (7) with respect to the revolution (U);

in each track (S1, S2, S3), the conveyance of the front end region (27) through the cutting plane (S) is started and/or stopped individually per track and based on the angular position (Φ) of the cutting blade (7);

in a first one of the plurality of tracks (S1, S2, S3), the conveyance of the front end region (27) through the cutting plane (S) is started at a first value of the angular position (Φ) of the cutting blade (7);

in a second one of the plurality of tracks (S1, S2, S3), the conveyance of the front end region (27) through the cutting plane (S) is started at a second value of the angular position (Φ) of the cutting blade (7); and the second value of the angular position (Φ) of the cutting blade (7) is different than the first value of the angular position (Φ) of the cutting blade (7).

2. The apparatus in accordance with claim 1, wherein the apparatus is a high-performance slicer.

3. The apparatus in accordance with claim 1, wherein the cutting blade (7) moves in a rotating and/or circulating manner.

4. The apparatus in accordance with claim 1, wherein each cut-off product layer (13) is an individual slice or a portion formed from a plurality of slices.

5. The apparatus in accordance with claim 1, wherein each conveying device (19) is configured to start and/or stop conveying the respective front end region (27) of the respective interleaved sheet material web (21) through the cutting plane (S) individually per track based on the angular position (Φ) of the cutting blade (7).

6. The apparatus in accordance with claim 1, wherein each conveying device (19) is configured to start conveying the respective front end region (27) of the respective interleaved sheet material web (21) individually per track as soon as the angular position (Φ) of the cutting blade (7) corresponds to an angular position value which is or can be predefined for the respective conveying device (19).

7. The apparatus in accordance with claim 6, wherein with at least one conveying device (19), the angular position value corresponds at least approximately to the angular position (Φ) at which the cutting blade (7) in the respective track (S1, S2, S3) releases a cross-sectional region disposed in the cutting plane (S) through which the front end region (27) of the respective interleaved sheet material web (21) is conveyed.

8. The apparatus in accordance with claim 6, wherein with at least one conveying device (19), the angular position value corresponds at least approximately to the angular position (Φ), at which the cutting blade (7) has completely cut off a slice (13) of one of the cut-off product layers (13).

9. The apparatus in accordance with claim 6, wherein a different angular position value is or can be predefined for each conveying device (19).

10. The apparatus in accordance with claim 6, wherein the respective angular position value is dependent on the cutting blade (7) and/or on a cutting blade head.

11. The apparatus in accordance with claim 6, wherein the respective angular position value is dependent on the speed of rotation of the blade and/or on the cutting speed.

12. The apparatus in accordance with claim 6, wherein the respective angular position value is dependent on the respective product (3).

13. The apparatus in accordance with claim 12, wherein the respective angular position value is dependent on the shape, on the height and/or on the width of the product (3).

14. The apparatus in accordance with claim 6, wherein the respective angular position value is dependent on the arrangement of the cutting blade (7) relative to the tracks (S1, S2, S3) and/or to the products (3).

15. The apparatus in accordance with claim 14, wherein the respective angular position value is dependent on the arrangement of an axis of rotation (M, D) of the cutting blade (7) or of a blade head.

16. The apparatus in accordance with claim 1, wherein each conveying device (19) is configured to stop the respective conveying device individually per track as soon as the angular position (Φ) of the cutting blade (7) corresponds to a further angular position value which is or can be predefined for the respective conveying device.

17. The apparatus in accordance with claim 1, wherein each conveying device (19) is configured to convey the respective front end region (27) of the respective interleaved sheet material web (21) for a length of time which is predefined or which can be predefined.

18. The apparatus in accordance with claim 17, wherein the length of time is predefined or can be predefined individually per track.

19. The apparatus in accordance with claim 1, wherein the cutting blade (7) is a circular knife orbiting in a planetary motion.

20. The apparatus in accordance with claim 1, wherein the cutting blade (7) is a scythe-like blade rotating about a central axis (D) of the cutting blade (7).

21. A method of providing interleaved sheets on multi-tracks, wherein food products (3) are sliced in a plurality of tracks (S1, S2, S3) running in parallel next to one another by a cutting blade (7) rotating in a cutting plane (S) through a revolution (U) about a central axis (M), in each track (S1, S2, S3) a front end region (27) of an interleaved sheet material web (21) is conveyed by a conveying device of an interleaver through the cutting plane (S) based on an angular position (Φ) of the cutting blade (7) with respect to the revolution (U) and independently of the other tracks (S1, S2, S3) to provide the front end region (27) of the interleaved sheet material web as an interleaved sheet between cut-off product layers (13), in each track (S1, S2, S3), the conveyance of the front end region (27) through the cutting plane (S) is started and/or stopped individually per track and based on the angular position (Φ) of the cutting blade (7), in a first one of the plurality of tracks (S1, S2, S3), the conveyance of the front end region (27) through the cutting plane (S) is started at a first value of the angular position (Φ) of the cutting blade (7), in a second one of the plurality of tracks (S1, S2, S3), the conveyance of the front end region (27) through the cutting plane (S) is started at a second value of the angular position (Φ) of the cutting blade (7), and the second value of the angular position (Φ) of the cutting blade (7) is different than the first value of the angular position (Φ) of the cutting blade (7).

22. The method in accordance with claim 21, wherein each cut-off product layer (13) is an individual slice or a portion formed by a plurality of slices.

23. The method in accordance with claim 21, wherein in each track (S1, S2, S3), the conveyance of the front end region (27) through the cutting plane (S) is started as soon as the angular position (Φ) of the cutting blade (7) corresponds to an angular position value which is or can be predefined individually per track.

24. The method in accordance with claim 23, wherein the conveyance of the front end region (27) through the cutting plane (S) is started when the angular position value corresponds at least approximately to the angular position (Φ) at which the cutting blade (7) in the respective track (S1, S2, S3) releases a cross-sectional region disposed in the cutting plane (S) through which the front end region (27) of the respective interleaved sheet material web (21) is conveyed; and/or when the angular position value corresponds at least approximately to the angular position (Φ) at which the cutting blade (7) has completely cut off a slice (13) of one of the cut-off product layers (13) in the respective track (S1, S2, S3).

25. The method in accordance with claim 21, wherein in each track (S1, S2, S3), the angular position value is set based on the cutting blade (7) and/or on a cutting blade head.

26. The method in accordance with claim 21, wherein in each track (S1, S2, S3), the angular position value is set based on the speed of rotation of the blade and/or on the cutting speed.

27. The method in accordance with claim 21, wherein in each track (S1, S2, S3), the angular position value is set based on the respective product (3).

28. The method in accordance with claim 27, wherein in each track (S1, S2, S3), the angular position value is set based on the shape, on the height and/or on the width of the product (3).

29. The method in accordance with claim 21, wherein in each track (S1, S2, S3), the angular position value is set based on the arrangement of the cutting blade (7) relative to the tracks (S1, S2, S3) and/or to the products (3).

30. The method in accordance with claim 29, wherein the angular position value is set based on the arrangement of an axis of rotation (M, D) of the cutting blade (7) or of a blade head.

31. The method in accordance with claim 21, wherein in each track (S1, S2, S3), the conveyance of the front end region (27) through the cutting plane (S) is stopped as soon as the angular position (Φ) of the cutting blade (7) corresponds to an angular position value which is or can be predefined individually per track.

32. The method in accordance with claim 21, wherein in each track (S1, S2, S3), the conveyance of the front end region (27) through the cutting plane (S) is carried out for a length of time which is provided or which can be predefined individually per track.

33. The method in accordance with claim 21, wherein the conveyance of the front end region (27) through the cutting plane (S) is automatically adapted based on the speed of rotation of the cutting blade (7).

34. The method in accordance with claim 21, wherein the central axis (M) is parallel to and spaced apart from a central axis (D) of the cutting blade (7).

35. The method in accordance with claim 21, wherein the cutting blade (7) is a circular knife orbiting in a planetary motion.

36. The method in accordance with claim 21, wherein the cutting blade (7) is a scythe-like blade rotating about a central axis (D) of the cutting blade (7).

* * * * *